United States Patent [19]

Ishida et al.

[11] Patent Number: 4,627,610

[45] Date of Patent: Dec. 9, 1986

[54] MULTI-PURPOSE EXERCISING APPARATUS

[75] Inventors: Hiroshi Ishida, La Mirada, Calif.; Yujen Wang, Tainan, Taiwan

[73] Assignee: Rocket Industries, Inc., Pico Rivera, Calif.

[21] Appl. No.: 718,153

[22] Filed: Apr. 1, 1985

[51] Int. Cl.[4] ..... A63B 69/06; A63B 21/00

[52] U.S. Cl. ..... 272/72; 272/130; 272/134; 272/144

[58] Field of Search ..... 272/72, 130, 134–139, 272/141, 142, 144, 145

[56] References Cited

U.S. PATENT DOCUMENTS

| | | | |
|---|---|---|---|
| 3,130,968 | 4/1964 | Defeen | 272/134 X |
| 3,792,860 | 2/1974 | Selnes | 272/72 X |
| 4,257,590 | 3/1981 | Sullivan et al. | 272/144 X |
| 4,477,071 | 10/1984 | Brown et al. | 272/130 X |
| 4,521,013 | 6/1985 | Dofel | 272/142 X |

*Primary Examiner*—Robert E. Bagwill
*Assistant Examiner*—Kathleen D'Arrigo

[57] ABSTRACT

An exercising apparatus which can be used as a rowing machine or for performing other types of exercises not possible with a rowing machine, by having the pivotally mounted ends of the lever members of the rowing machine-type exerciser selectively movable between a position on the base frame and a position on a vertically extending column member adjacent the foremost end of the base frame.

The base frame contains a longitudinally extending track, with a seat mounted on the track for longitudinal movement relative thereto when the lever arms are in the rowing-machine position.

An elongate body support member is provided for mounting on the frame in longitudinal alignment with the seat when the levers are pivotally mounted on the column member, to provide a surface upon which the user can stand or lie while actuating the lever members.

14 Claims, 15 Drawing Figures

MULTI-PURPOSE EXERCISING APPARATUS

BACKGROUND AND BRIEF SUMMARY OF THE INVENTION

This invention relates generally to exercising devices, and more particularly to a novel multi-purpose exercising apparatus.

In the field of exercising, the prior art has provided a multitude of single purpose devices, each of which is designed to afford the user a single desired exercise, e.g. rowing or cycling. However, it has long been recognized that to improve and/or maintain one's physical fitness, it is desirable to exercise various muscles of the body, which usually requires various types of exercises and exercising devices.

In recent years, a number of multi-purpose exercising devices have been developed, such by rearranging parts and/or by adding and removing parts, the devices can be made to afford the user a number of different exercises which are suitable for attaining and maintaining complete physical fitness.

A recent development which has achieved some success, is called a convertible rowing exercising apparatus and is shown and described in U.S. Pat. No. 4,477,071.

Briefly stated, the aforesaid apparatus is basically a rowing machine which also includes a padded bench member adapted to be mounted at the front end of the device, generally perpendicular to the horizontal frame of the rowing machine, whereby when the assembly is tilted or rotated 90° to cause the bench member to be in a horizontal position and the frame of the rowing machine to be in a generally vertical position, the same rowing arms or levers can be utilized to perform exercises different from rowing, and which are referred to generally as bench press, military press, curls and squats.

One serious disadvantage of the aforesaid convertible rowing exercising apparatus is that because of its weight and arrangement, it is difficult for a person of limited strength or agility, to tilt or rotate the apparatus between the rowing position and the bench press position.

Another serious disadvantage of the aforesaid convertible rowing exercising apparatus is that the tilting of the device between the two positions can cause injury to the person handling it, and can cause damage to adjacent objects such as furniture.

And, because it was necessary to limit the weight of the apparatus in order to permit it to be tilted or rotated, it is not as rugged or strong as might be desired by large and/or powerful users.

With the aforegoing limitations and deficiencies of known devices in mind, it is an object of the present invention to provide a novel multi-purpose exercising apparatus which can be utilized for performing substantially all known types of exercises without requiring the machine to be physically moved from one position to another, e.g. by tilting or rotating. More particularly, it is an object to provide an exercising apparatus which can be utilized for performing the conventional rowing exercise as well as squats, curls, bench presses and military presses without endangering the safety of the user or causing damage to adjacent objects. Specifically, it is an object to provide such an exercising apparatus which can easily and quickly be converted from a rowing-type device to a bench-type device for performing other exercises such as the aforesaid squats, curls, bench presses and military presses.

Another object is to provide a novel multi-purpose exercising apparatus which can be made as strong and as heavy as required to accommodate users of various sizes, weight, agility and strength, without considering the necessity of making the device of a limited size or weight whereby it can be rotated or tilted.

A further object is to provide such a novel multi-purpose exercising apparatus which includes a relatively limited number of parts, which is strong and durable, and which is easy to operate by even the most inexperienced user.

We have discovered that the foregoing objects and advantages are achieved by providing releasable attachment means at the pivotally mounted ends of the lever members on the base frame of a rowing-type exerciser; providing a vertically-extending column member adjacent the foremost end of the frame of the rowing-type exerciser; and providing like releasable attachment means on the column member at a predetermined height above the base frame . . . whereby the pivotally mounted ends of the lever members are selectively movable between the frame and the column member to provide two distinct exercising positions. An elongate body support member is also provided for mounting on the base frame in alignment with the rowing seat to provide a surface upon which the user can stand or lie when the lever members are pivotally mounted on the column member.

Other objects and advantages of the subject invention will be apparent and fully understood from the following detailed description of one typical preferred embodiment, throughout which description reference is made to the accompanying drawings.

DETAILED DESCRIPTION OF THE INVENTION

Figure 1:
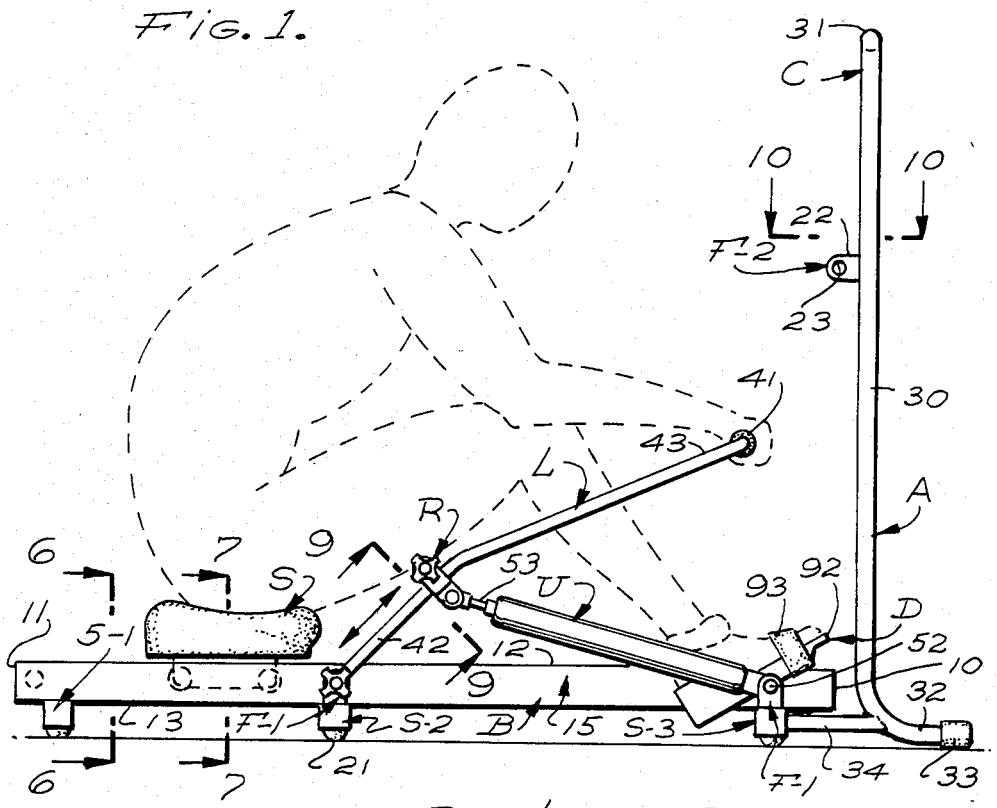
FIG. 1 is a side elevational view of a multi-purpose exercising apparatus constructed in accordance with the teachings of the present invention, with the parts in the rowing position.
Figure 2:
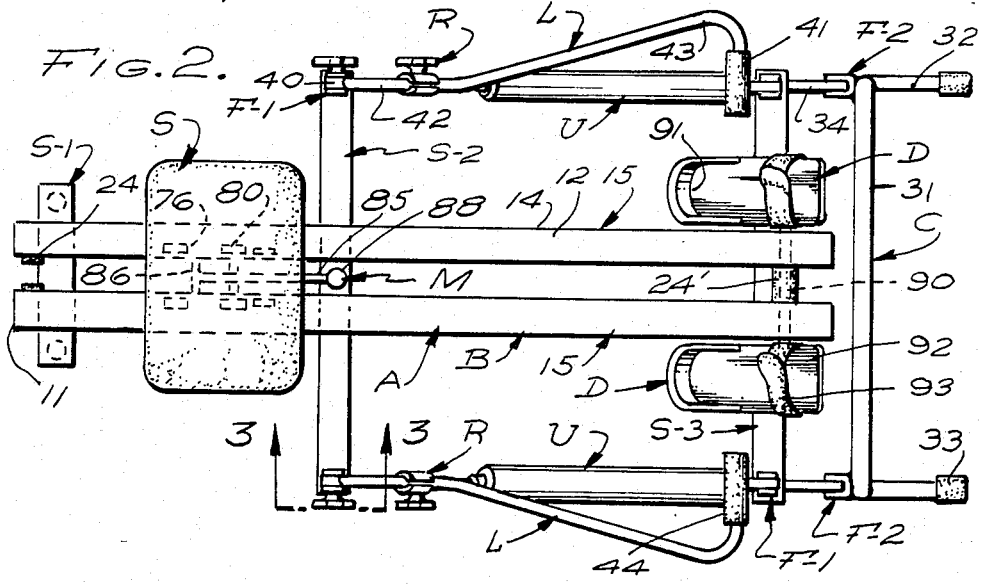
FIG. 2 is a top plan view of the apparatus shown in FIG. 1.
Figure 3:
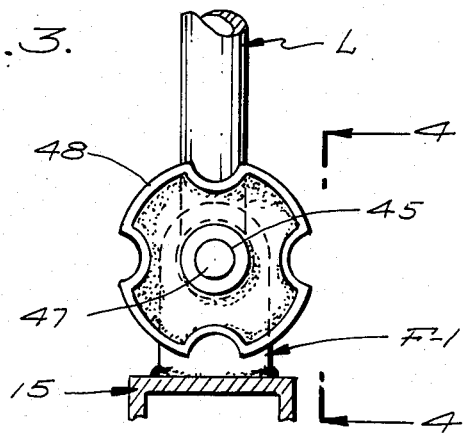
FIG. 3 is an enlarged side elevational view taken substantially as indicated by line 3—3 in FIG. 2.

Referring to the drawings more particularly be reference letters and numerals, particularly FIGS. 1 and 2, the multi-purpose exercising apparatus embodying the teachings of the present invention includes an L-shaped frame A with an elongate horizontal base B and a vertical column C.

Figure 6:
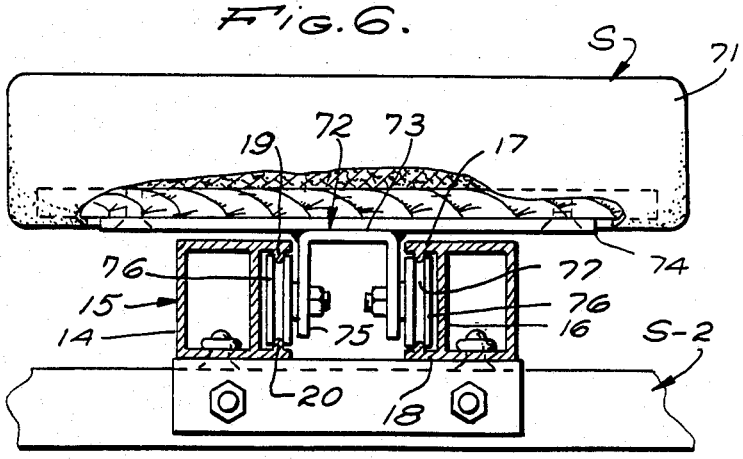
FIG. 6 is an enlarged vertical detailed sectional view taken substantially as indicated by line 6—6 in FIG. 1.
Figure 7:
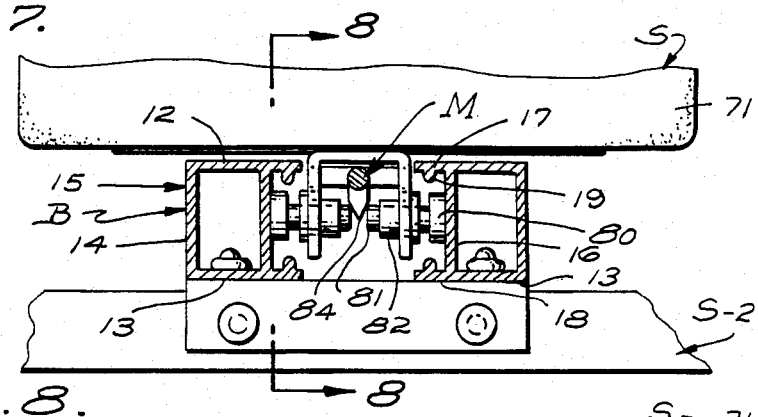
FIG. 7 is an enlarged vertical detailed sectional view taken substantially as indicated by line 7—7 in FIG. 1.
Figure 8:
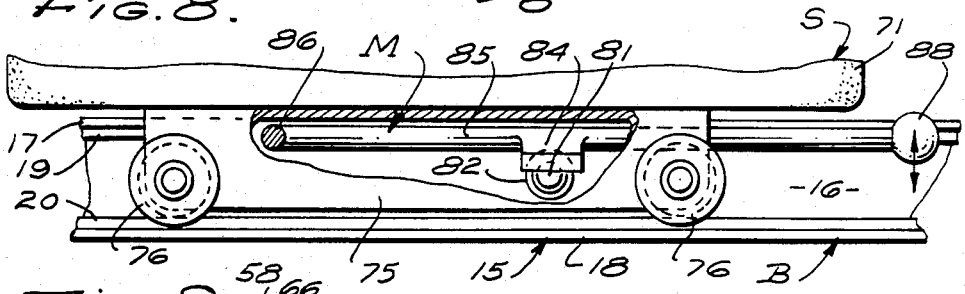
FIG. 8 is a sectional view taken substantially as indicated by line 8—8 in FIG. 7.

The base B includes a pair of laterally spaced longitudinally extending metal stringers 15, with front and rear ends 10 and 11, horizontal top and bottom walls 12 and 13, laterally outwardly disposed outer side walls 14 and vertical, laterally inwardly disposed, laterally spaced and opposing inner walls 16 (FIGS. 6 and 7). In addition, the stringers 15 have longitudinally extending vertically spaced upper and lower horizontal flanges 17 and 18 at their inner sides (FIGS. 6 and 7). The upper and lower flanges 17 and 18 are formed with longitudinally extending, vertically downwardly and upperwardly projecting opposed upper and lower rails 19 and 20. The top walls 12 of the stringers 15 define the top plane of the base B.

The stringers 15 are fixed together in parallel relationship by three longitudinally spaced laterally extending spreaders S-1, S-2 and S-3 extending transversely between the stringers and projecting laterally outwardly therefrom. In the preferred carrying out of the invention, the spreaders are lengths of box section metal tube stock.

The stringers S-1, S-2 and S-3 are preferably provided with downwardly projecting deck engaging pads 21 at their opposite end portions.

The front and central spreaders S-3 and S-2 project a sufficient distance laterally outwardly from the opposite sides of the pair or stringers to provide the frame A with considerable stability. The rear spreader S-1 is substantially shorter than the other spreaders, as shown in FIG. 2.

Figure 4:
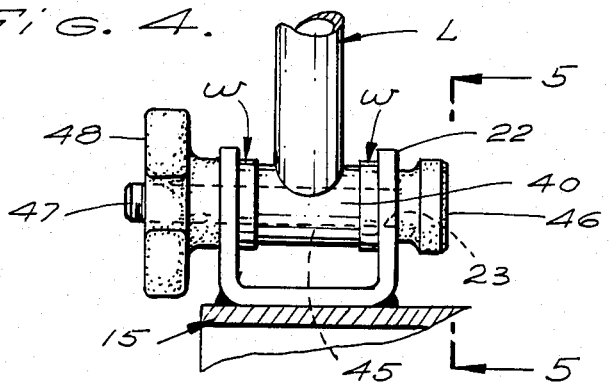
FIG. 4 is a transverse, elevational view taken as indicated by line 4—4 in FIG. 3.
Figure 5:
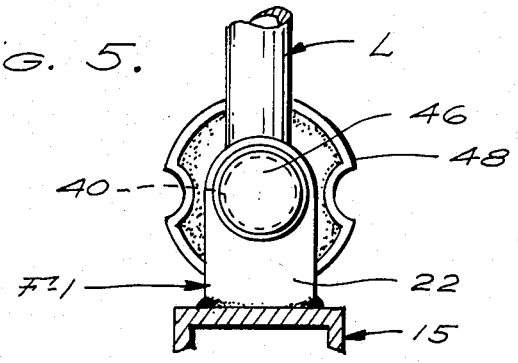
FIG. 5 is a vertical, elevational view taken as indicated by line 5—5 in FIG. 4.

The opposite ends of the front and central spreaders S-3 and S-2 are provided with similar types of upwardly projecting clevis fittings F-1 with flat laterally spaced parallel plates 22 formed with axially aligned openings 23 (FIG. 4).

The rear end portions of the stringers 15 (FIG. 2) are shown provided with laterally inwardly projecting resilient stops 24 In practice, the ends of the stringers 15 and spreaders can be closed by decorative caps or plugs (not shown).

Column C of Frame A is an inverted U-shaped tubular metal unit with laterally spaced vertical legs 30 and a horizontal transversely extending header 31 joined with and extending between the upper ends of the legs. The lower ends of the legs 30 of column C have forwardedly projecting horizontal feet 32, the forward ends of which are capped with deck-engaging caps 33.

The lower ends of the legs 30 of the column C are fixed to end portions of the front spreader S-3 of the base B by elongate horizontal tubular connectors 34. In the case illustrated, the connectors 34 are welded to the lower ends of the legs 30 and to the front sides of the front spreader S-3.

Figure 12:
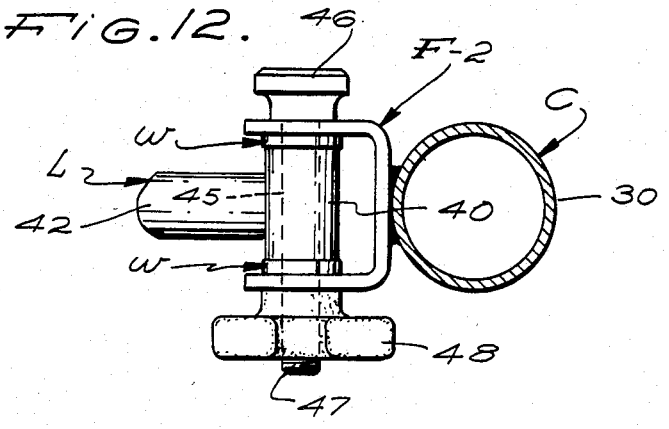
FIG. 12 is an enlarged, fragmentary horizontal sectional view taken as indicated by line 12—12 in FIG. 11.
Figure 11:
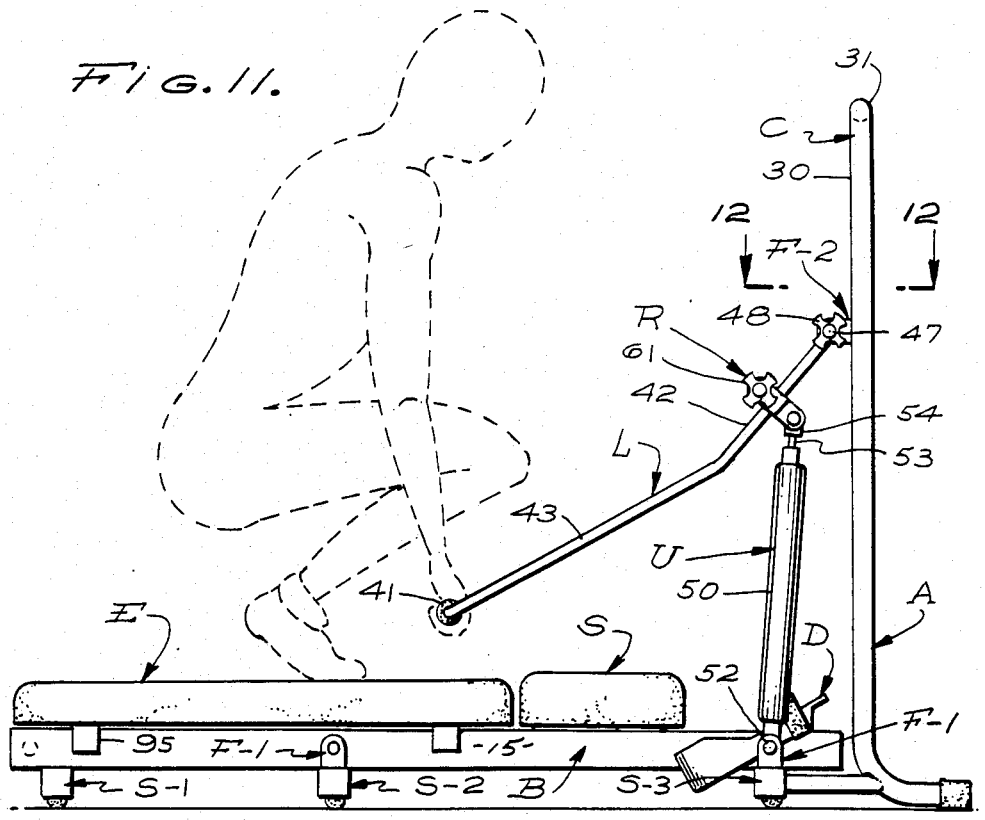
FIG. 11 is another side elevational view of the apparatus shown in FIG. 1, with the parts in the "bench" position.

Finally, column C includes clevis fittings F-2 (similar in construction to the fittings F-1 on the spreaders) on the legs 30 of the column and projecting rearwardly therefrom (FIGS. 1, 11 and 12).

The clevis fitting F-2 at each side of the column C is spaced above and slightly forward of the clevis fittings F-1 at the end of the front spreader S-3, and the fitting F-2 is spaced above the related clevis fitting F-1 on the front spreader S-3 a distance which is slightly less than the distance between the clevis fitting F-1 on the central spreader S-2 and the front spreader S-3, as will be discussed more fully hereinafter. Further, the several clevis fittings at each side of the frame occur on a common vertical plane.

The apparatus of the present invention further includes a pair of elongate pivotally mounted lever arms L at opposite sides of the frame. The lever arms L have inner ends provided with short laterally extending tubular metal bearing sleeves 40 (FIGS. 4 and 12) and outer ends containing laterally extending handle portions 41. The lever arms L are characterized by short straight portions 42 and by long laterally outwardly inclined portions 43 which are joined with the handle portions 41 by inwardly turned outer ends. The lever arms are preferably formed of a single length of metal tube stock.

The handle portions 41 are preferably provided with tubular rubber hand grips 44.

The bearing sleeve 40 (FIGS. 4 and 12) on each lever arm L is slightly less in axial extent than the lateral space between the plates 22 of the clevis fitting F-1 on the central spreader S-2 and the like fitting F-2 on the column C to accept Teflon washers W. The bearing sleeves 40 and washers W are selectively engageable in and with the above noted clevis fittings on the central spreader S-2 or on the column C by pivot pins 45 (FIGS. 4 and 12) removably engaged in and through said fittings and sleeves. The pins 45 have enlarged heads 46 at their inner ends and are threaded at their outer ends 47. Large internally threaded hand knobs 48 are engaged on the outer threaded ends 47 of the pins 45.

Figure 13:
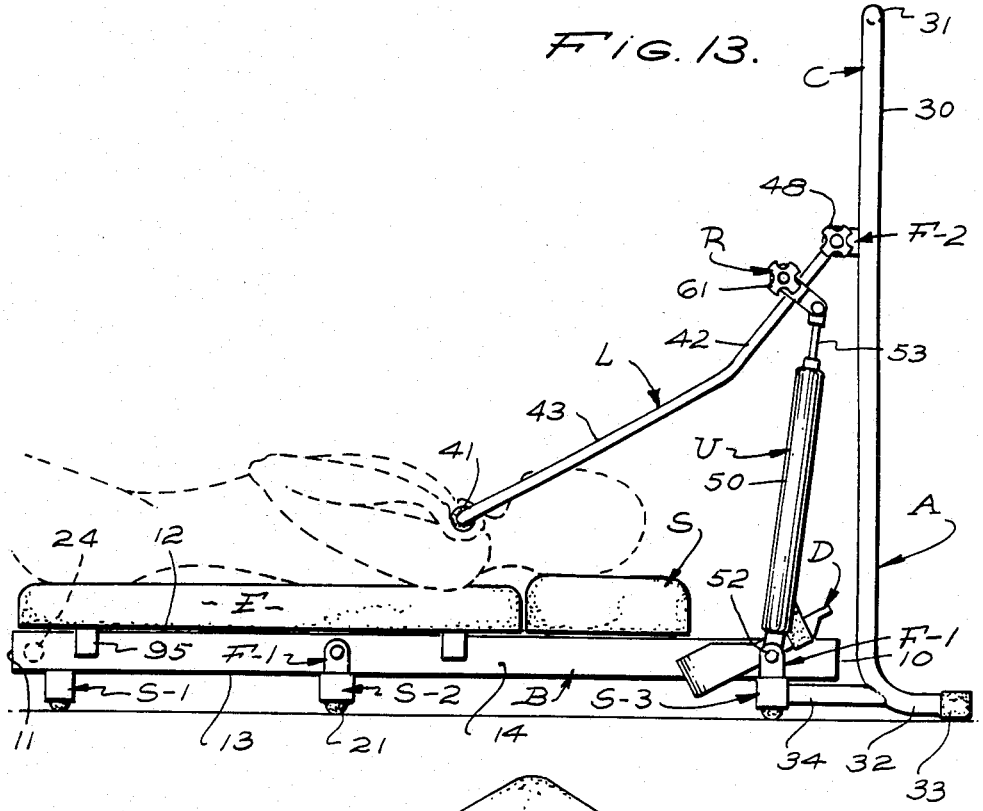
FIG. 13 is another side elevational view of the apparatus arranged as shown in FIG. 11, with the user in the bench press position.

With the structure thus far described, it will be apparent that the inner ends of the lever arms L can be releasably pivotally coupled with the clevis fittings F-1 on the central spreader S-2 of the base B to normally project forwardly and outwardly therefrom as shown in FIGS. 1 and 2, and alternatively, the same lever arms L can be releasably pivotally coupled with the clevis fittings F-2 on the column C to normally project substantially rearwardly therefrom as shown in FIGS. 11 and 13.

Moving the lever arms L between engagement with the clevis fittings F-1 on the central spreader S-2 and the clevis fittings F-2 on the column C is a simple, easy and quick to perform operation, and is effected by simply removing the hand knobs 48 from the pins 45, pulling the pins from engagement with the fittings F-1 and sleeves 40, swinging the lever arms L from one clevis fitting to the other, and reassemblying the pins and hand knobs with the related fittings and sleeves.

The novel multi-purpose exercising apparatus next includes shock absorber type cylinder and piston units U (FIGS. 1 and 2) adjustably connected to the lever arms L and to the clevis fittings F-1 at the ends of the forward spreader S-3. The units U can be hydraulic or pnumatic units, and are such that they resist axial extension of the units and allow for substantially free axial contraction thereof.

Each unit U includes an elongate cylinder 50 with a lower forward end provided with an apertured anchor fitting 51 engaged in an pivotally connected with its related clevis fitting F-1 on the forward spreader S-3 of the base B of the frame, as by a pivot end 52. Each unit U also includes a rod 53 which projects axially outwardly from the other end of the cylinder 50 and which has an apertured pivot fitting 54 (FIG. 9) at its upper rear end.

Figure 9:
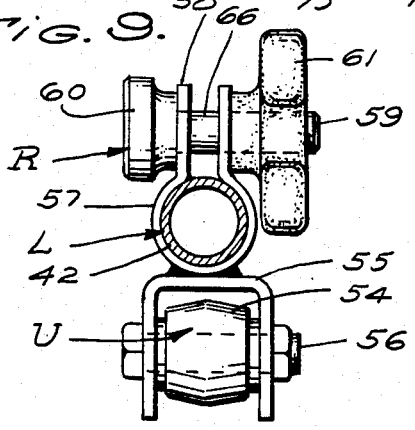
FIG. 9 is an enlarged vertical view taken as indicated by line 9—9 in FIG. 1.
Figure 10:
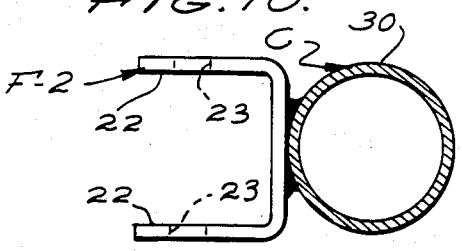
FIG. 10 is enlarged horizontal sectional view taken as indicated by line 10—10 in FIG. 1.

As shown in FIG. 9, the fitting 54 is pivotally connected with a clevis part 55 of a releasable clamp fitting R by a pivot pin fastener assembly 56. The clamp fitting R, in addition to the part 55 and the fastener assembly 56, includes a split band-like clamp part 57 with spaced apart end tabs 58. The tabs 58 have aligned apertures 59. The fitting 54 next and finally includes a headed clamp bolt 60 engaged through the apertures 59 and extending between the tabs 58, and a large internally threaded hand knob 61 on the free end of the bolt. The clamp part 57 of the fitting R is engaged about the straight inner portion 42 of its related lever arm L, and is releasably urged into tight clamping engagement with said portion of the lever arm by manually tightening the hand knob 61.

Upon loosening the knob 61, the fitting R can be moved longitudinally along the straight portion 52 of the lever arm L to increase or decrease the distance between the inner end of that arm and the point of pivotal connection of that lever arm with its related unit U, to thereby very the mechanical advantage afforded by the lever arm over the unit U.

The subject exercising apparatus next includes a roller supported seat S above and carried by the stringers 15 of the base B. As shown in FIGS. 6 through 9, the seat S includes a padded member 71 which is carried by a longitudinally extending downwardly opening channel part 72. The channel part 72 has a horizontal top wall 73 which occurs above the top plane of the stringers 15 and which is shown fastened to the bottom of the seat by a mounting plate 74 welded to the part 72 and screw fastened to the seat.

The channel part 72 next includes a pair of laterally spaced side walls 75 that depend into the space between the stringers 15. The wall 75 at each side of the part 72 occur in close running clearance with the inner sides of the stringers 15 and in close proximity with the longitudinally extending rails 19 and 20 thereof. Each side wall 75 carries a pair of longitudinally spaced rollers 76 with radially outwardly opening annular rail engaging grooves 77. The rollers 76 are such that when they are in rolling bearing engagement with one of their related rails 19 or 20, they are out of bearing engagement with the other of said rails, but said other rails remain in free non-bearing engagement in the grooves 77 thereof.

In addition to the above, the exercising aparatus includes brake means M (FIGS. 7 and 8) releasably locking the seat S on the base B of the frame in any desired longitudinal position. The brake means M includes a pair of laterally shiftable brake shoes 80 (FIG. 7) carried by the side walls 75 of the channel parts 72 between the front and rear rollers. The shoes 80 occur laterally outwardly of the walls 75 and are shiftable into and out of braking engagement with the inner walls 16 of the stringers 15. The shoes 80 are carried on laterally inwardly projecting stems 81 engaged through bearing blocks 82 carried by the side walls 75.

The shoes 80 are releasably urged laterally outwardly into braking engagement with the stringers 15 by a single wedge-like actuating blade 84 shiftable vertically into and out of tight engagement between the inner opposed ends of the stems 81. The blade 84 is fixed to and carried by an elongate braking arm 85 which is located within the channel part 72, above the stems 81, and which extends longitudinally forwardly from the rear end portion of the channel part 72, where it is pivotally mounted by a transversely extending pivot shaft 86 engaged in registering openings in the walls 75 of the channel part 72. The other forward end of the arm 85 projects freely forwardly from the front end of the seat S and has a manually engageable operating knob 88 at its forward end, which knob is accessible and manually engageable between the stringers 15.

With the braking means M described above, it will be apparent that by manually moving the knob 88 upwardly and downwardly, the blade 84 is moved out of and into engagement between the stems 81 and the shoes 80 and the shoes are moved out of and into braking engagement with the stringers 15.

The apparatus next includes a pair of laterally spaced foot rests D (FIG. 2) adjacent the front end portion of the base B of the frame. The foot rest D are positioned adjacent the outer sides of the pair of stringers 15, and are preferably pivotally mounted on the opposite end portions of a laterally extending rod 90 engaged through and carried by the stringers 15. The foot rests have rear heel receiving recesses 91 and forward toed engaging ends 92, and are provided with adjustable straps 93 for holding the user's feet in engagement with the foot rests.

The rod 90 can, as shown in FIG. 2, carry a rubber stop sleeve 24' to engage and limit forward movement of the seat S on the stringers 15. The previously noted stops 24 at the rear end of the stringers limit rearward movement of the seat S relatively to the stringers.

Figure 14:
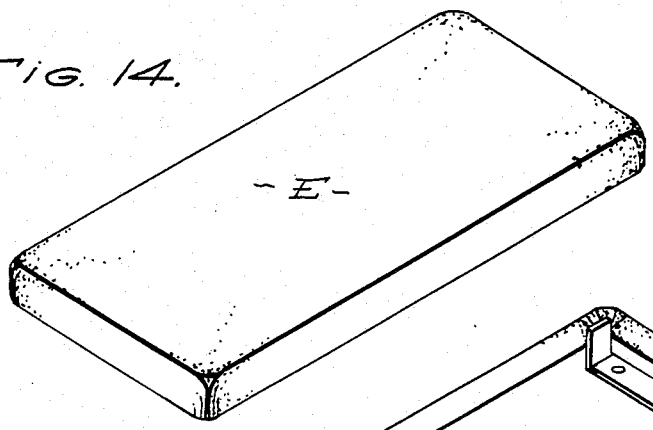
FIG. 14 is an isometric view showing the top, one end and one side of the body board.
Figure 15:
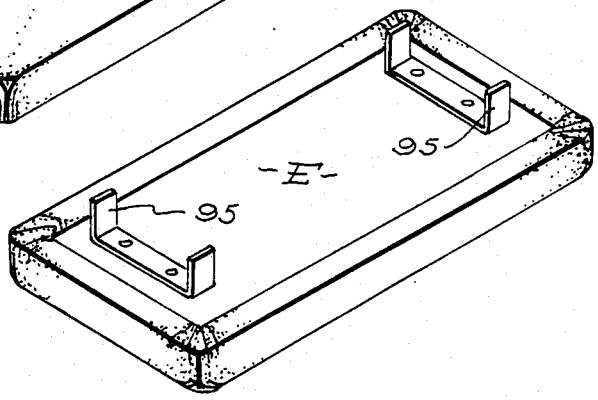
FIG. 15 is an isometric view showing the bottom, one end and the other side of the body board.

Next and finally, the exercise apparatus includes a removable body board E (FIGS. 13–15), primarily for use when the clevis fittings F-2 on the columns 30 are utilized, as shown in FIGS. 11 and 13.

The body board E is of substantial longitudinal extent and is arranged to be mounted on the stringers rearward of the seat S when the seat is in its foremost position, whereby the board and the seat cooperate to establish a shoulder-to-hip and head supporting assembly for use in performing the bench press exercise, as shown in FIG. 13. The board E can also be used for kneeling or for standing (FIG. 11).

The body board E (FIGS. 14 and 15) is a flat rectangular shaped board, substantially equal in width with the width of the seat S, and like the seat S, is provided with suitable padding at its top. The board E has a pair of longitudinally spaced, downwardly opening U-shaped retaining brackets 95 which frictionally embrace the pair of stringers 15 and releasably secure the board to the base of the frame, as clearly shown in FIGS. 11 and 13.

As shown in broken lines in FIG. 1, when the apparatus is used as a conventional rower-type exerciser, the user sits on the seat S (facing forwardly) with his/her feet positioned on the foot rest D, and pulls on the lever arms L in the usual manner.

In the rowing position, the inner ends of the lever arms L are engaged with the clevis fittings F-1 on the central spreader S-2 of the frame and the pivotally mounted ends of the cylinder and piston units U remain mounted on the clevis fittings F-1 on the forward stringer S-3 (FIGS. 1 and 2).

To use the subject exercising apparatus in the bench position (FIGS. 11 and 13), the inner ends of the lever arms L are moved from the clevis fittings F-1 on the intermediate stringer S-2 to the like clevis fittings F-2 on the columns 30, by merely disengaging and re-engaging the pins 45 utilizing the hand knobs 48 as previously described; the seat S is moved to its foremost position; and the body board E is positioned on the stringers 15. In this position, the user can perform various additional exercises including curls, squats, bench press and military press.

Thus, it will be readily apparant that the novel multi-purpose exercising apparatus constructed in accordance with the teachings of the present invention, can be utilized to perform all of the most commonly used exercises . . . including all of the exercises which can be performed using the apparatus of U.S. Pat. No. 4,477,071 . . . without the necessity of tipping or rotating the machine through 90° (as with the apparatus of U.S. Pat. No. 4,477,071), with its attendant physical strain and likelihood of physical injury or damage to adjacent furniture.

And, because it is not necessary to tip the subject exercising apparatus to perform different types of exercises, it can be made as sturdy and strong as necessary for use by any and all users. In short, the subject exercising apparatus can be made for use in gymnasiums, as well as for use in the home.

Having described our invention, we do not intend to be limited to the specific details set forth above, but desire to reserve to ourselves any modifications and variations that may appear to those skilled in the art and which fall within the scope of the following claims.

We claim:

1. A multi-purpose exercising apparatus for selective usage as a rowing machine or for performing other types of exercises such as a bench press, comprising:

a generally horizontal base frame having opposed sides and a forward end and a rearward end;

a longitudinally-extending track on said frame;

a seat mounted on said track for longitudinal movement relative to said frame;

at least one movable lever member having the inner end thereof connectable to said frame by releasable attachment means for pivotal movement relative to said frame and containing handle means at the other end thereof to be grasped and moved by a user's hand;

elongate resistent means having one end thereof operatively connected to said lever member providing resistence to the pivotal movement of said lever member, the other end of said resistence member being connected to the frame;

foot bracing means mounted on the frame for bracing the user's feet during use of the apparatus as a rowing machine;

a vertically extending column member attached to the base frame adjacent the forward end thereof; and attachment means on said column member for receiving and releasably connecting the inner end of the lever member to said column member for pivotal movement relative thereto when said inner member is not connected to the base frame, thereby providing means for performing exercises not available using a rowing machine.

2. a multi-purpose exercising apparatus according to claim 1, which further includes an elongate body board for mounting on the base frame adjacent to the seat.

3. A multi-purpose exercising apparatus according to claim 1, which includes means for releasably locking the seat on the track in a selected longitudinal position relative to the base frame.

4. A multi-purpose exercising apparatus according to claim 1, which contains two movable lever members for pivotal connection to opposite sides of the base frame by releasable attachment means, and attachment means on said column member for releasably connecting the inner ends of both lever members for pivotal movement relative to said column member when the lever members are not connected to the base frame.

5. A multi-purpose exercising apparatus for selective usage as a rowing machine or for performing other types of exercises such as a bench press, comprising:

a generally horizontal base frame having opposed sides and a forward end and a rearward end;

a longitudinally extending track on said frame;

a seat mounted on said track for longitudinal movement relative to said frame;

two movable lever members, one at each side of the base frame, each having the inner end thereof connectable to said frame by releasable attachment means including a bracket member mounted on the frame, for pivotal movement relative to the frame, each of said lever members containing handle means at the outer end thereof to be grasped and moved by a user's hand;

two elongate resistant means for providing resistance to the pivotal movement of the lever members, the inner end of each resistant means being operatively connected to a lever member and the other end of each resistance means being connected to the base frame adjacent the forwards end thereof;

foot bracing means mounted on the base frame adjacent the forward end thereof for bracing the user's feet during use of the apparatus as a rowing machine;

a vertically extending column member having opposed sides, attached to the base frame adjacent the forward end thereof; and attachment means including a bracket member on said column member adjacent each side thereof for releasably connecting the inner ends of each lever member to said column member for pivotal movement relative thereto when said inner end is not connected to the base frame.

6. A multi-purpose exercising apparatus according to claim 5, in which the bracket members mounted on the frame for releasable attachment of the inner ends of the lever arms thereto and the bracket members on the column member for a like purpose, are similar in size and configuration.

7. A multi-purpose exercising apparatus according to claim 5, in which the bracket member at each side of the base frame and the related bracket member on the like side of the column member lie in substantially the same vertical plane relative to the base frame.

8. A multi-purpose exercising apparatus according to claim 5, in which the vertically extending column member is of inverted U-shape.

9. A multi-purpose exercising apparatus according to claim 5, in which the vertically extending column member is of tubular material and is of inverted U-shape, and the bracket members for receiving the inner ends of the lever members are of U-shape.

10. A multi-purpose exercising apparatus according to claim 5, in which the releasable attachment means for the inner end of each of the lever arms includes a threaded bolt with an internally threaded hand knob mounted on the free end thereof.

11. A multi-purpose exercising apparatus according to claim 5, in which the horizontal distance between the bracket members mounted on the frame for receiving the inner ends of the lever members and the connections on the base frame for said other ends of the resistance means, is generally the same as the distance between the latter and the bracket members on the column member for receiving the lever members.

12. A multi-purpose exercising apparatus according to claim 5, which further includes an elongate body board for mounting on the base frame in longitudinal alignment with the seat when the latter is in its foremost position.

13. A multi-purpose exercising apparatus according to claim 5, which includes means for releasably locking the seat on the track in a selected longitudinal position relative to the base frame.

14. A multi-purpose exercising apparatus according to claim 13, in which the track includes two spaced-apart rails, and the releasable locking means includes a pivotally mounted lever which extends from beneath the seat and between said rails.

* * * * *